US008338807B2

(12) United States Patent
Avnery et al.

(10) Patent No.: US 8,338,807 B2
(45) Date of Patent: Dec. 25, 2012

(54) ELECTRON BEAM EMITTER

(75) Inventors: Tzvi Avnery, Winchester, MA (US); Kenneth P. Felis, Stowe, VT (US)

(73) Assignee: Hitachi Zosen Corporation, Suminoe-Ku (JP)

( * ) Notice: Subject to any disclaimer, the term of this patent is extended or adjusted under 35 U.S.C. 154(b) by 0 days.

(21) Appl. No.: 13/079,602

(22) Filed: Apr. 4, 2011

(65) Prior Publication Data

US 2011/0266942 A1 Nov. 3, 2011

Related U.S. Application Data

(63) Continuation of application No. 11/964,273, filed on Dec. 26, 2007, now Pat. No. 7,919,763, which is a continuation of application No. 11/879,674, filed on Jul. 18, 2007, now Pat. No. 7,329,885, which is a continuation of application No. 10/751,676, filed on Jan. 5, 2004, now Pat. No. 7,265,367, which is a continuation-in-part of application No. 10/103,539, filed on Mar. 20, 2002, now Pat. No. 6,674,229, which is a continuation-in-part of application No. 09/813,929, filed on Mar. 21, 2001, now abandoned.

(51) Int. Cl.
*H01J 33/04* (2006.01)

(52) U.S. Cl. ..... 250/492.3; 313/420

(58) Field of Classification Search ..... 250/492.3; 313/420

See application file for complete search history.

(56) References Cited

U.S. PATENT DOCUMENTS

| | | | | |
|---|---|---|---|---|
| 3,778,655 | A | 12/1973 | Luce | |
| 4,333,036 | A | 6/1982 | Farrell | |
| 4,591,756 | A | 5/1986 | Avnery | |
| 5,210,426 | A | 5/1993 | Itoh et al. | |
| 5,235,239 | A | 8/1993 | Jacob et al. | |
| 5,317,618 | A | 5/1994 | Nakahara et al. | |
| 5,378,898 | A | 1/1995 | Schonberg et al. | |
| 5,416,440 | A | 5/1995 | Lyons et al. | |
| 5,962,995 | A | 10/1999 | Avnery | |
| 6,054,714 | A | 4/2000 | Izutsu et al. | |
| 6,407,492 | B1 | 6/2002 | Avnery et al. | |
| 6,545,398 | B1 | 4/2003 | Avnery | |
| 6,800,989 | B2 * | 10/2004 | Avnery | 313/341 |
| 7,329,885 | B2 | 2/2008 | Avnery et al. | |

FOREIGN PATENT DOCUMENTS

DE 529237 7/1931

(Continued)

OTHER PUBLICATIONS

Hughey, B.J., et al., "Design Considerations for Foil Windows for PET Radioisotope Targets," *Targetry '91: Proceedings of the 4. International Workshop on Targetry and Target Chemistry*: 11-18 (1992).

(Continued)

*Primary Examiner* — Kiet T Nguyen
(74) *Attorney, Agent, or Firm* — Ropes & Gray LLP

(57) ABSTRACT

An exit window for an electron beam emitter through which electrons pass in an electron beam includes a structural foil for metal to metal bonding with the electron beam emitter. The structural foil has a central opening formed therethrough. A window layer of high thermal conductivity extends over the central opening of the structural foil and provides a high thermal conductivity region through which the electrons can pass.

20 Claims, 6 Drawing Sheets

FOREIGN PATENT DOCUMENTS

| | | |
|---|---|---|
| EP | 0 480 732 B1 | 4/1992 |
| EP | 0 715 314 | 6/1996 |
| GB | 301719 | 12/1928 |
| JP | 58-117100 | 7/1983 |
| JP | 63-263488 | 10/1988 |
| JP | 01-187500 | 7/1989 |
| JP | 02138900 | 5/1990 |
| JP | 03-170033 | 7/1991 |
| JP | 08-240542 | 9/1996 |
| JP | 10-082900 | 3/1998 |
| JP | 11052098 | 2/1999 |
| JP | 2001-235600 | 8/2001 |
| WO | WO-94/07248 | 3/1994 |
| WO | WO-98/07175 | 2/1998 |

OTHER PUBLICATIONS

Khounsary, Ali M. and Kuzay, T.M., "On Diamond Windows for High Power Synchrotron X-Ray Beams," NTIS, DE92007366 (1991).

Kuroda, K., et al., "Efficient Extraction Window for High-Throughput X-Ray Lithography Beamlines," *Rev. Sci. Instrum. 66*(2), Feb. 1995, 2151-2153 (1994).

Khounsary, Ali M., "Thermal, Structural, and Fabrication Aspects of Diamond Windows for High Power Synchrotron X-Ray Beamlines," *SPIE, Vo. 1739 High Heat Flux Engineering* (1992), 266-281.

* cited by examiner

ELECTRON BEAM EMITTER

RELATED APPLICATIONS

This application is a Continuation of U.S. application Ser. No. 11/964,273, filed Dec. 26, 2007, which is a Continuation of U.S. application Ser. No. 11/879,674, filed Jul. 18, 2007, now U.S. Pat. No. 7,329,885, which is a Continuation of U.S. application Ser. No. 10/751,676, filed Jan. 5, 2004, now U.S. Pat. No. 7,265,367, which is a continuation-in-part of U.S. application Ser. No. 10/103,539, filed Mar. 20, 2002, now U.S. Pat. No. 6,674,229, which is a continuation-in-part of U.S. application Ser. No. 09/813,929, filed Mar. 21, 2001. The entire teachings of the above applications are incorporated herein by reference.

BACKGROUND

A typical electron beam emitter includes a vacuum chamber with an electron generator positioned therein for generating electrons. The electrons arc accelerated out from the vacuum chamber through an exit window in an electron beam. Typically, the exit window is formed from a metallic foil. The metallic foil of the exit window is commonly formed from a high strength material such as titanium in order to withstand the pressure differential between the interior and exterior of the vacuum chamber.

A common use of electron beam emitters is to irradiate materials such as inks and adhesives with an electron beam for curing purposes. Other common uses include the treatment of waste water or sewage, or the sterilization of food or beverage packaging. Some applications require particular electron beam intensity profiles where the intensity varies laterally. One common method for producing electron beams with a varied intensity profile is to laterally vary the electron permeability of either the electron generator grid or the exit window. Another method is to design the emitter to have particular electrical optics for producing the desired intensity profile. Typically, such emitters are custom made to suit the desired use.

SUMMARY

The present invention includes an exit window for an electron beam emitter through which electrons pass in an electron beam. For a given exit window foil thickness, the exit window is capable of withstanding higher intensity electron beams than currently available exit windows. In addition, the exit window is capable of operating in corrosive environments. The exit window includes an exit window foil having an interior and an exterior surface. A corrosion resistant layer having high thermal conductivity is formed over the exterior surface of the exit window foil for resisting corrosion and increasing thermal conductivity. The increased thermal conductivity allows heat to be drawn away from the exit window foil more rapidly so that the exit window foil is able to handle electron beams of higher intensity which would normally burn a hole through the exit window.

In one embodiment, the exit window foil has a series of holes formed therein. The corrosion resistant layer extends over the holes of the exit window foil and provides thinner window regions which allow easier passage of the electrons through the exit window. The exit window foil is formed from titanium about 6 to 12 microns thick and the corrosion resistant layer is formed from diamond about 5 to 8 microns thick.

The present invention also includes an electron beam emitter including a vacuum chamber with an electron generator positioned within the vacuum chamber for generating electrons. The vacuum chamber has an exit window through which the electrons exit the vacuum chamber in an electron beam. The exit window includes an exit window foil having an interior and exterior surface with a series of holes formed therein. A corrosion resistant layer having high thermal conductivity is formed over the exterior surface and the holes of the exit window foil for resisting corrosion and increasing thermal conductivity. The layer extending over the holes of the exit window foil provides thinner window regions which allow easier passage of the electrons through the exit window.

In one embodiment, the electron beam emitter includes a support plate for supporting the exit window. The support plate has a series of holes therethrough which are aligned with holes of the exit window foil. In some embodiments, multiple holes of the exit window foil can be aligned with each hole of the support plate.

A method of forming an exit window for an electron beam emitter through which electrons pass in an electron beam includes providing an exit window foil having an interior and an exterior surface. A corrosion resistant layer having high thermal conductivity is formed over the exterior surface of the exit window foil for resisting corrosion and increasing thermal conductivity. A series of holes are formed in the exit window foil to provide thinner window regions where the layer extends over the holes of the exit window foil which allow easier passage of the electrons through the exit window.

In the present invention, by providing an exit window for an electron beam emitter which has increased thermal conductivity, thinner exit window foils are possible. Since less power is required to accelerate electrons through thinner exit window foils, an electron beam emitter having such an exit window is able to operate more efficiently (require less power) for producing an electron beam of a particular intensity. Alternatively, for a given foil thickness, the high thermal conductive layer allows the exit window in the present invention to withstand higher power than previously possible for a foil of the same thickness to produce a higher intensity electron beam. In addition, forming thinner window regions which allow easier passage of the electrons through exit window can further increase the intensity of the electron beam or require less power for an electron beam of equal intensity. Finally, the corrosion resistant layer allows the exit window to be exposed to corrosive environments while operating.

The present invention also includes an exit window for an electron beam emitter through which electrons pass in an electron beam. The exit window has a structural foil for metal to metal bonding with the electron beam emitter. The structural foil has a central opening formed therethrough. A window layer of high thermal conductivity extends over the central opening of the structural foil and provides a high thermal conductivity region through which the electrons can pass.

In particular embodiments, the window layer is formed of diamond and the structural foil is titanium foil. The diamond layer can be about 3 to 20 microns thick and the titanium foil can be about 10 to 1000 microns thick. The exit window can include an intermediate layer of silicon having a central opening formed therethrough corresponding to the central opening through the structural foil, the layer of silicon being between the layer of diamond and the structural foil. The silicon layer can be about 0.25 to 1 mm thick. The diamond layer is supported by a support plate of the electron beam emitter.

The present invention further includes an electron beam emitter having a vacuum chamber and an electron generator positioned with the vacuum chamber for generating electrons. An exit window is included on the vacuum chamber through which the electrons exit the vacuum chamber in an electron beam. The exit window includes a structural foil for metal to metal bonding with the vacuum chamber of the electron beam emitter. The structural foil has a central opening formed therethrough, and a window layer of high thermal conductivity extends over the central opening of the structural foil and provides a high thermal conductivity region through which the electrons can pass. The window layer can be formed of diamond.

The present invention also includes a method of forming an exit window for an electron beam emitter through which electrons pass in an electron beam. A window layer of high thermal conductivity is formed over a substrate. A central opening is formed through the substrate such that the window layer extends over the central opening and provides a high thermal conductivity region through which electrons can pass. A structural foil is extended outwardly from the window layer for metal to metal bonding with the electron beam emitter. The structural foil has a central opening formed therethrough. The window layer can be formed of diamond.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
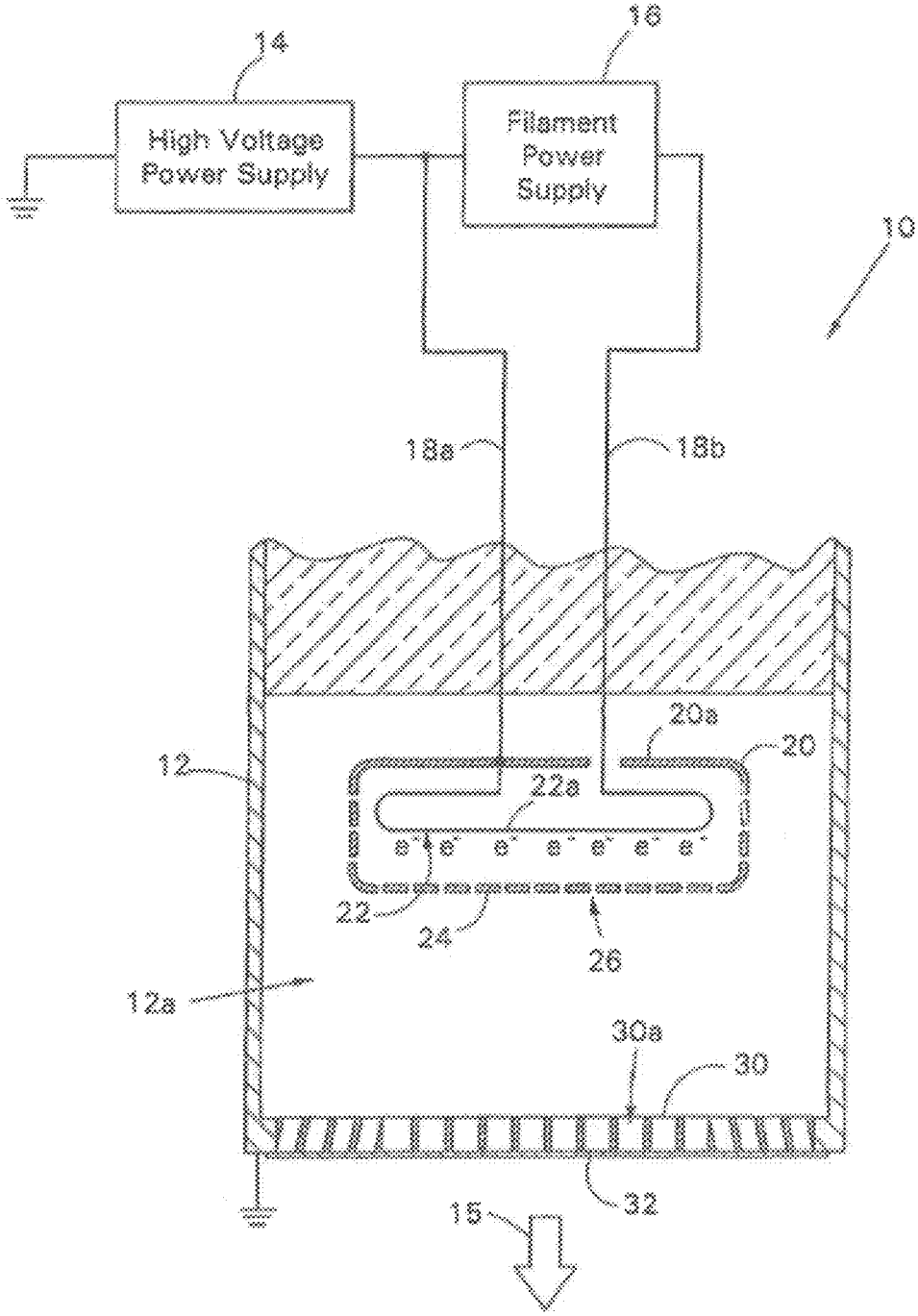
FIG. 1 is a schematic sectional drawing of an electron beam emitter of the present invention.

Referring to FIG. 1, electron beam emitter 10 includes a vacuum chamber 12 having an exit window 32 at one end thereof. An electron generator 20 is positioned within the interior 12*a* of vacuum chamber 12 for generating electrons $e^-$ which exit the vacuum chamber 12 through exit window 32 in an electron beam 15. In particular, the electrons $e^-$ are generated by an electron generating filament assembly 22 positioned within the housing 20*a* of the electron generator 20 and having one or more electron generating filaments 22*a*. The bottom 24 of housing 20*a* includes series of grid-like openings 26 which allow the electrons $e^-$ to pass therethrough. The cross section of each filament 22*a* is varied (FIG. 2) to produce a desired electron generating profile. Specifically, each filament 22*a* has at least one larger or major cross sectional area portion 34 and at least one smaller or minor cross sectional area portion 36, wherein the cross sectional area of portion 34 is greater than that of portion 36. The housing 20*a* and filament assembly 22 are electrically connected to high voltage power supply 14 and filament power supply 16, respectively, by lines 18*a* and 18*b*. The exit window 32 is electrically grounded to impose a high voltage potential between housing 20*a* and exit window 32, which accelerates the electrons $e^-$ generated by electron generator 20 through exit window 32. The exit window 32 includes a structural foil 32*a* (FIG. 10) that is sufficiently thin to allow the passage of electrons $e^-$ therethrough. The exit window 32 is supported by a rigid support plate 30 that has holes 30*a* therethrough for the passage of electrons $e^-$. The exit window 32 includes an exterior coating or layer 32*b* of corrosion resistant high thermal conductive material for resisting corrosion and increasing the conductivity of exit window 32.

In use, the filaments 22*a* of electron generator 20 are heated up to about 4200° F. by electrical power from filament power supply 16 (AC or DC) which causes free electrons $e^-$ to form on the filaments 22*a*. The portions 36 of filaments 22*a* with smaller cross sectional areas or diameters typically have a higher temperature than the portions 34 that have a larger cross sectional area or diameter. The elevated temperature of portions 36 causes increased generation of electrons at portions 36 in comparison to portions 34. The high voltage potential imposed between filament housing 20*a* and exit window 32 by high voltage power supply 14 causes the free electrons $e^-$ on filaments 22*a* to accelerate from the filaments 22*a* out through the openings 26 in housing 20*a*, through the openings 30*a* in support plate 30, and through the exit window 32 in an electron beam 15. The intensity profile of the electron beam 15 moving laterally across the electron beam 15 is determined by the selection of the size, placement and length of portions 34/36 of filaments 22*a*. Consequently, different locations of electron beam 15 can be selected to have higher electron intensity. Alternatively, the configuration of portions 34/36 of filaments 22*a* can be selected to obtain an electron beam 15 of uniform intensity if the design of the electron beam emitter 10 normally has an electron beam 15 of nonuniform intensity.

The corrosion resistant high thermal conductive coating 32*b* on the exterior side of exit window 32 has a thermal conductivity that is much higher than that of the structural foil 32*a* of exit window 32. The coating 32*b* is sufficiently thin so as not to substantially impede the passage of electrons $e^-$ therethrough but thick enough to provide exit window 32 with a thermal conductivity much greater than that of foil 32*a*. When the structural foil 32*a* of an exit window is relatively thin (for example, 6 to 12 microns thick), the electron beam 15 can burn a hole through the exit window if insufficient amounts of heat is drawn away from the exit window. Depending upon the material of foil 32*a* and coating 32*b*, the addition of coating 32*b* can provide exit window 32 with a thermal conductivity that is increased by a factor ranging from about 2 to 8 over that provided by foil 32*a*, and therefore draw much more heat away than if coating 32*b* was not present. This allows the use of exit windows 32 that are thinner than would normally be possible for a given operating power without burning holes therethrough. An advantage of a thinner exit window 32 is that it allows more electrons $e^-$ to pass therethrough, thereby resulting in a higher intensity electron beam 15 than conventionally obtainable and more efficient or at higher energy. Conversely, a thinner exit window 32 requires less power for obtaining an electron beam 15 of a particular intensity and is therefore more efficient. By forming the conductive coating 32*b* out of corrosion resistant material, the exterior surface of the exit window 32 is also made to be corrosion resistant and is suitable for use in corrosive environments.

A more detailed description of the present invention now follows. FIG. 1 generally depicts electron beam emitter 10. The exact design of electron beam emitter 10 may vary depending upon the application at hand. Typically, electron beam emitter 10 is similar to those described in U.S. patent application Ser. Nos. 09/349,592 filed Jul. 9, 1999 and 09/209,024 filed Dec. 10, 1998, the contents of which are incorporated herein by reference in their entirety. If desired, electron beam emitter 10 may have side openings on the filament housing as shown in FIG. 1 to flatten the high voltage electric field lines between the filaments 22*a* and the exit window 32 so that the electrons exit the filament housing 20*a* in a generally dispersed manner. In addition, support plate 30 may include angled openings 30*a* near the edges to allow electrons to pass through exit window at the edges at an outwardly directed angle, thereby allowing electrons of electron beam 15 to extend laterally beyond the sides of vacuum chamber 12. This allows multiple electron beam emitters 10 to be stacked side by side to provide wide continuous electron beam coverage.

Figure 2:
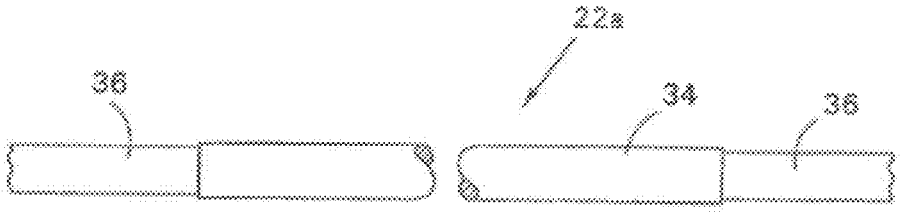
FIG. 2 is a side view of a portion of the electron generating filament.
Figure 3:
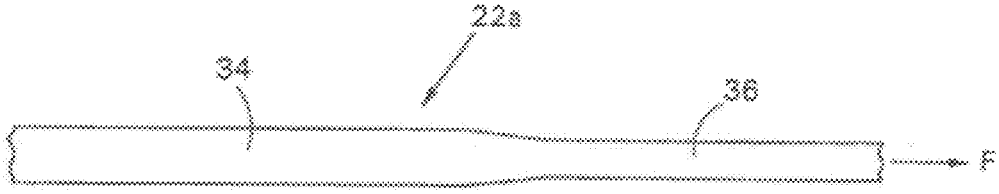
FIG. 3 is a side view of a portion of the electron generating filament depicting one method of forming the filament.

Referring to FIG. 2, filament 22*a* typically has a round cross section and is formed of tungsten. As a result, the major cross sectional area portion 34 is also a major diameter portion and the minor cross sectional area portion 36 is also a minor diameter portion. Usually, the major diameter portion 34 has a diameter that is in the range of 0.010 to 0.020 inches. The minor diameter portion 36 is typically sized to provide 1° C. to 20° C. increase in temperature (in some cases, as little as 1° F. to 2° F.) because such a small increase in temperature can result in a 10% to 20% increase in the emission of electrons $e^-$. The diameter of portion 36 required to provide such an increase in temperature relative to portion 36 is about 1 to 10 microns (in some cases, 1 to 5 microns) smaller than portion 34. The removal of such a small amount of material from portions 36 can be performed by chemical etching such as with hydrogen peroxide, electrochemical etching, stretching of filament 22*a* as depicted in FIG. 3, grinding, EDM machining, the formation and removal of an oxide layer, etc. One method of forming the oxide layer is to pass a current through filament 22*a* while filament 22*a* is exposed to air.

In one embodiment, filament 22*a* is formed with minor cross sectional area or diameter portions 36 at or near the ends (FIG. 2) so that greater amounts of electrons are generated at or near the ends. This allows electrons generated at the ends of filament 22*a* to be angled outwardly in an outwardly spreading beam 15 without too great a drop in electron density in the lateral direction. The widening electron beam allows multiple electron beam emitters to be laterally stacked with overlapping electron beams to provide uninterrupted wide electron beam coverage. In some applications, it may also be desirable merely to have a higher electron intensity at the ends or edges of the beam. In some cases, the ends of a filament are normally cooler than central areas so that electron intensity drops off at the ends. Choosing the proper configuration of portions 34 and 36 can provide a more uniform temperature profile along the length of the filament and therefore more uniform electron intensity. In another embodiment where there is a voltage drop across the filament 22*a*, a minor cross sectional area or diameter portion 36 is positioned at the far or distal end of filament 22*a* to compensate for the voltage drop resulting in an uniform temperature and electron emission distribution across the length of filament 22*a*. In other embodiments, the number and positioning of portions 34 and 36 can be selected to suit the application at hand.

Figure 4:
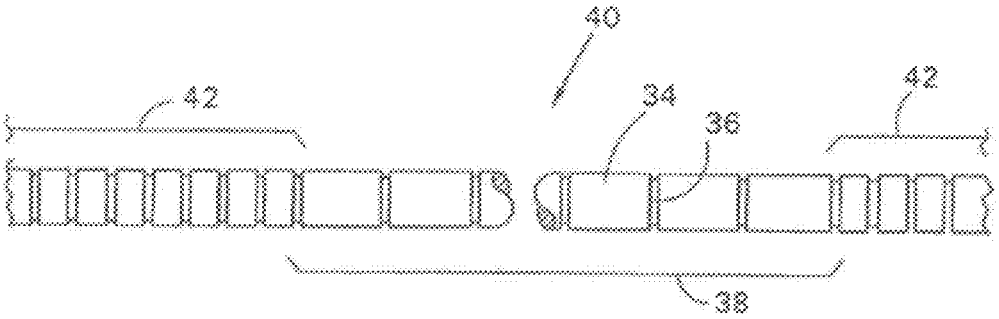
FIG. 4 is a side view of a portion of another embodiment of the electron generating filament.

Referring to FIG. 4, filament 40 may be employed within electron beam emitter 10 instead of filament 22*a*. Filament 40 includes a series of major cross sectional area or diameter portions 34 and minor cross sectional area or diameter portions 36. The minor diameter portions 36 are formed as narrow grooves or rings which are spaced apart from each other at selected intervals. In the region 38, portions 36 are spaced further apart from each other than in regions 42. As a result, the overall temperature and electron emission in regions 42 is greater than in region 38. By selecting the width and diameter of the minor diameter 36 as well as the length of the intervals therebetween, the desired electron generation profile of filament 40 can be selected.

Figure 5:
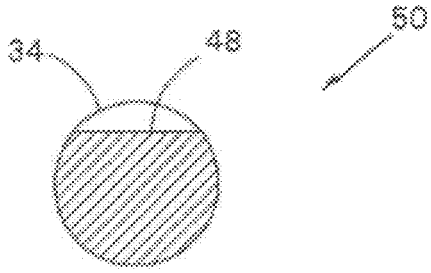
FIG. 5 is a cross sectional view of still another embodiment of the electron generating filament.
Figure 6:
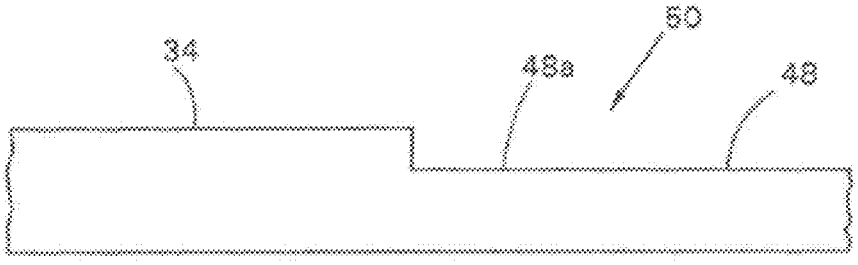
FIG. 6 is a side view of a portion of the electron generating filament depicted in FIG. 5.

Referring to FIGS. 5 and 6, filament 50 is still another filament which can be employed with electron beam emitter 10. Filament 50 has at least one major cross sectional area or diameter 34 and at least one continuous minor cross sectional area 48 formed by the removal of a portion of the filament material on one side of the filament 50. FIGS. 5 and 6 depict the formation of minor cross sectional area 48 by making a flattened portion 48*a* on filament 50. The flattened portion 48*a* can be formed by any of the methods previously mentioned. It is understood that the flattened portion 48*a* can alternatively be replaced by other suitable shapes formed by the removal of material such as a curved surface, or at least two angled surfaces.

Figure 7:
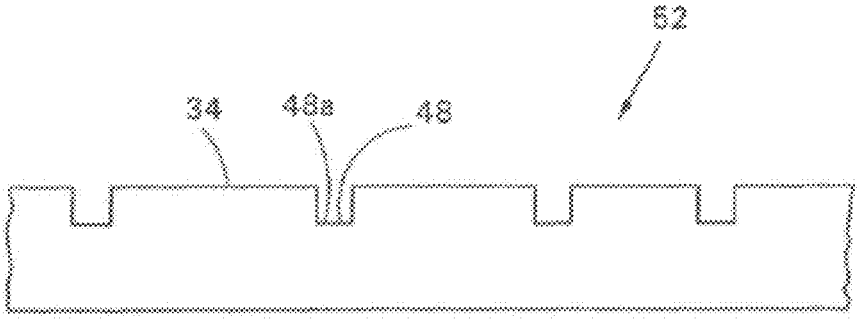
FIG. 7 is a side view of a portion of yet another embodiment of the electron generating filament.

Referring to FIG. 7, filament 52 is yet another filament which can be employed within electron beam emitter 10. Filament 52 differs from filament 50 in that filament 52 includes at least two narrow minor cross sectional areas 48 which are spaced apart from each other at selected intervals in a manner similar to the grooves or rings of filament 40 (FIG. 4) for obtaining desired electron generation profiles. The narrow minor cross sectional areas 48 of filament 52 can be notches as shown in FIG. 7 or may be slight indentations, depending upon the depth. In addition, the notches can include curved angled edges or surfaces.

Figure 8:
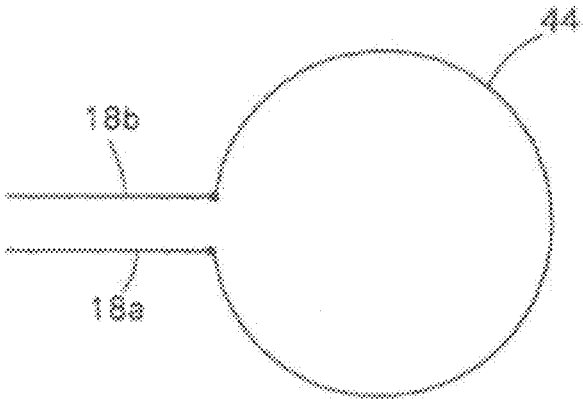
FIG. 8 is a top view of another electron generating filament.

Referring to FIG. 8, filament 44 is another filament which can be employed within electron beam emitter 10. Instead of being elongated in a straight line as with filament 22*a*, the length of filament 44 is formed in a generally circular shape. Filament 44 can include any of the major and minor cross sectional areas 34, 36 and 48 depicted in FIGS. 2-7 and arranged as desired. Filament 44 is useful in applications such as sterilizing the side walls of a can.

Figure 9:
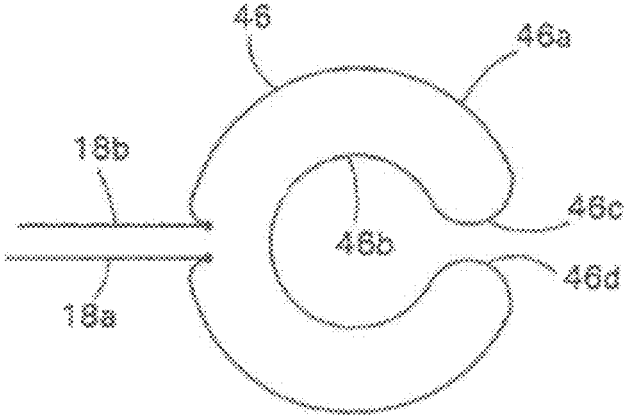
FIG. 9 is a top view of still another electron generating filament.

Referring to FIG. 9, filament 46 is still another filament which can be employed within electron beam emitter 10. Filament 46 includes two substantially circular portions 46*a* and 46*b* which are connected together by legs 46*c* and are concentric with each other. Filament 46 can also include any of the major and minor cross sectional areas 34, 36 and 48 depicted in FIGS. 2-7.

Figure 10:
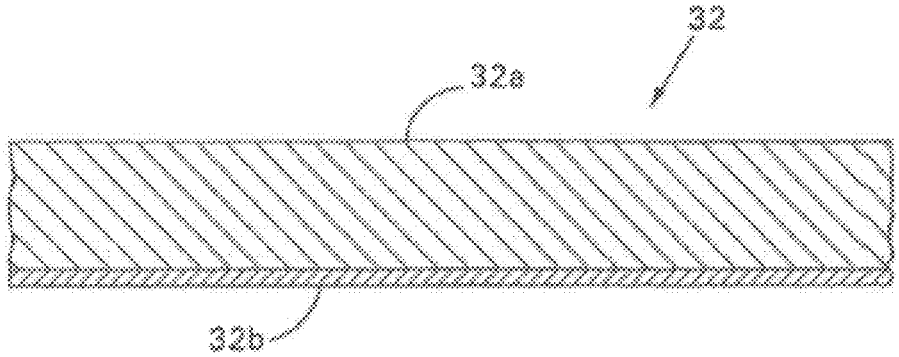
FIG. 10 is a cross sectional view of a portion of the exit window.

Referring to FIG. 10, the structural foil 32*a* of exit window 32 is typically formed of metal such as titanium, aluminum, or beryllium foil. The corrosion resistant high thermal conductive coating or layer 32*b* has a thickness that does not substantially impede the transmission of electrons $e^-$ therethrough. Titanium foil that is 6 to 12 microns thick is usually preferred for foil 32*a* for strength but has low thermal conductivity. The coating of corrosion resistant high thermal conductive material 32*b* is preferably a layer of diamond, 0.25 to 2 microns thick, which is grown by vapor deposition on the exterior surface of the metallic foil 32*a* in a vacuum at high temperature. Layer 32*b* is commonly about 4% to 8% the thickness of foil 32*a*. The layer 32*b* provides exit window 32 with a greatly increased thermal conductivity over that provided only by foil 32*a*. As a result, more heat can be drawn from exit window 32, thereby allowing higher electron beam intensities to pass through exit window 32 without burning a hole therethrough than would normally be possible for a foil 32*a* of a given thickness. For example, titanium typically has a thermal conductivity of 11.4 W/m·k. The thin layer of diamond 32*b*, which has a thermal conductivity of 500-1000 W/m·k, can increase the thermal conductivity of the exit window 32 by a factor of 8 over that provided by foil 32*a*. Diamond also has a relatively low density (0.144 lb./in.$^3$) which is preferable for allowing the passage of electrons $e^-$ therethrough. As a result, a foil 32*a* 6 microns thick which would normally be capable of withstanding power of only 4 kW, is capable of withstanding power of 10 kW to 20 kW with layer 32*b*. In addition, the diamond layer 32*b* on the exterior surface of the foil 32*a* is chemically inert and provides corrosion resistance for exit window 32. Corrosion resistance is desirable because sometimes the exit window 32 is exposed to environments including corrosive chemical agents. One such corrosive agent is hydrogen peroxide. The corrosion resistant high thermal conductive layer 32*b* protects the foil 32*a* from corrosion, thereby prolonging the life of the exit window 32. Titanium is generally considered to be corrosion resistant in a wide variety of environments but can be attacked by some environments under certain conditions such as high temperatures.

Although diamond is preferred in regard to performance, the coating or layer 32*b* can be formed of other suitable corrosion resistant materials having high thermal conductivity such as gold. Gold has a thermal conductivity of 317.9 W/m·k. The use of gold for layer 32*b* can increase the conductivity over that provided by the titanium foil 32*a* by a factor of about 2. Typically, gold would not be considered desirable for layer 32*b* because gold is such a heavy or dense material (0.698 lb./in$^3$) which tends to impede the transmission of electrons $e^-$ therethrough. However, when very thin layers of gold are employed, 0.1 to 1 microns, impedance of the electrons $e^-$ is kept to a minimum. When forming the layer of material 32*b* from gold, the layer 32*b* is typically formed by vapor deposition but, alternatively, can be formed by other suitable methods such as electroplating, etc.

In addition to gold, layer 32*b* may be formed from other materials from group 1b of the periodic table such as silver and copper. Silver and copper have thermal conductivities of 428 W/m·k and 398 W/m·k, and densities of 0.379 lb./in.$^3$ and 0.324 respectively, but are not as resistant to corrosion as gold. Typically, materials having thermal conductivities above 300 W/m·k are preferred for layer 32*b*. Such materials tend to have densities above 0.1 lb./in.$^3$, with silver and copper being above 0.3 lb./in.$^3$ and gold being above 0.6 lb./in.$^3$. Although the corrosion resistant highly conductive layer of material 32*b* is preferably located on the exterior side of exit window for corrosion resistance, alternatively, layer 32*b* can be located on the interior side, or a layer 32*b* can be on both sides. Furthermore, the layer 32*b* can be formed of more than one layer of material. Such a configuration can include inner layers of less corrosion resistant materials, for example, aluminum (thermal conductivity of 247 W/m·k and density of 0.0975 lb./in.$^3$), and an outer layer of diamond or gold. The inner layers can also be formed of silver or copper. Also, although foil 32*a* is preferably metallic, foil 32*a* can also be formed from non-metallic materials.

Figure 11:
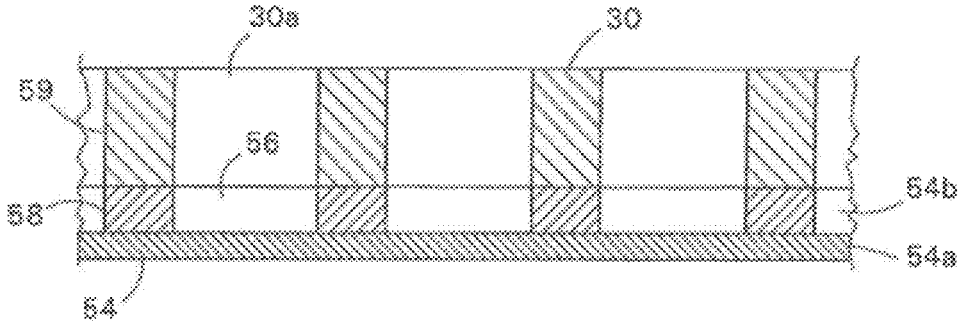
FIG. 11 is a cross sectional view of a portion of another embodiment of an exit window supported by a support plate.

Referring to FIG. 11, exit window 54 is another embodiment of an exit window which includes a structural foil 54*b* with a corrosion resistant high thermal conductive outer coating or layer 54*a*. Exit window 54 differs from the exit window 32 shown in FIG. 10 in that the structural foil 54*b* has a series of holes 56 which align with the holes 30*a* of the support plate 30 of an electron beam emitter 10, so that only the layer 54*a* covers or extends over holes 30*a*/56. As a result, the electron beam 15 only needs to pass through the layer 54*a*, which offers less resistance to electron beam 15, thereby providing easier passage therethrough. This allows the electron beam 15 to have a high intensity at a given voltage, or alternatively, require lower power for a given electron beam 15 intensity. The structural foil 54*b* has regions of material 58 contacting the regions 59 of support plate 30 which surround holes 30*a*. This allows heat from the exit window 54 to be drawn into the support plate 30 for cooling purposes as well as structural support.

In one embodiment, layer 54*a* is formed of diamond. In some situations, layer 54*a* can be 0.25-8 microns thick, with 5-8 microns being typical. Larger or smaller thicknesses can be employed depending upon the application at hand. Since the electrons e-passing through layer 54*a* via holes 56 do not need to pass through the structural foil 54*b*, the structural foil 54*b* can be formed of a number of different materials in addition to titanium, aluminum and beryllium, for example stainless steel or materials having high thermal conductivity such as copper, gold and silver. A typical material combination for exit window 54 is having an outer layer 54*a* of diamond and a structural foil 54*b* of titanium. With such a combination, one method of forming the holes 56 in the structural foil 54*b* is by etching processes for selectively removing material from structural foil 54*b*. When formed from titanium, structural foil 54*b* is typically in the range of 6-12 microns thick but can be larger or smaller depending upon the situation at hand. The configuration of exit window 54 in combination with materials such as diamond and titanium, provide exit window 54 with high thermoconductivity. Diamond has a low Z number and low resistance to electron beam 15.

Figure 12:
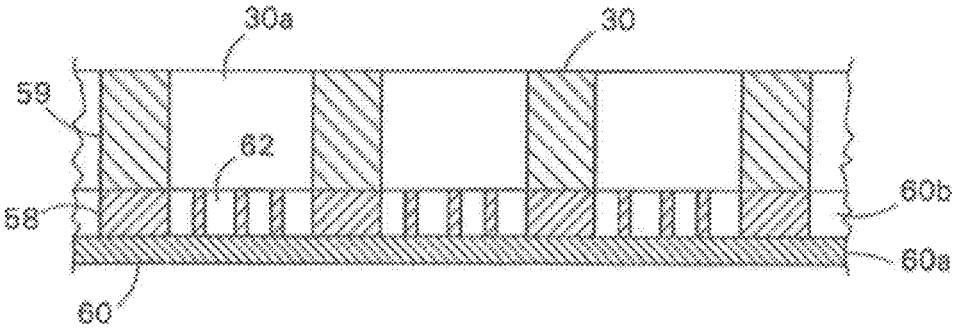
FIG. 12 is a cross sectional view of a portion of still another embodiment of an exit window supported by a support plate.

Referring to FIG. 12, exit window 60 is another embodiment of an exit window which includes a structural foil 60*b* with a corrosion resistant high thermal conductive outer coating or layer 60*a*. Exit window 60 differs from exit window 54 in that structural foil 60*b* has multiple holes 62 formed therein which align with each hole 30*a* in the support plate 30. This design can be used to employ thinner layers 60*a* than possible in exit window 54. FIG. 12 shows structural foil 60*b* to have regions of material 58 aligned with the regions 59 of support plate 30. Alternatively, the regions 58 of structural foil 60*b* can be omitted so that structural foil 60*b* has a continuous pattern or series of holes 62. Such a configuration can be sized so that just about any placement of exit window 60 against support plate 30 aligns multiple holes 62 in the structural foil 60*b* with each hole 30*a* in the support plate 30. It is understood that some holes 62 may be blocked or only partially aligned with a hole 30*a*. In both exit windows 54 and 60, maintaining portions or regions of the structural foil 54*b*/60*b* across the exit windows 54/60, provides strength for the exit windows 54/60. In addition, holes 56 and 62 typically range in size from about 0.040 to 0.100 inches and holes 30*a* in support plate 30 typically range in size from about 0.050 to 0.200 inches with 0.125 inches being common. In some embodiments, holes 56 and 62 only partially extend through structural foils 54*b* and 60*b*. In such embodiments, layers 54*a*160*a* are still considered to extend over the holes 56/62. Exit windows 54 and 60 are typically bonded in metal to metal contact with support plate 30 under heat and pressure to provide a gas tight seal, but also can be welded or brazed. Alternatively, exit windows 54 and 60 can be sealed by other conventional sealing means. Furthermore, in some embodiments of exit windows 54 and 60, the structural foils 54*b*/60*b* can be on the exterior or outside and the high thermal conductive layers 54*a*/60*a* on the inside such that the conductive layers 54*a*/60*a* abut the support plate 30. In such embodiments, the holes 56/62 in the structural foils 54*b*/60*b* are located on the exterior side of exit windows 54/60. When the high thermal conductive layers 54*a*/60*a* are on the inside, materials that are not corrosion resistant can be used.

Figure 13:
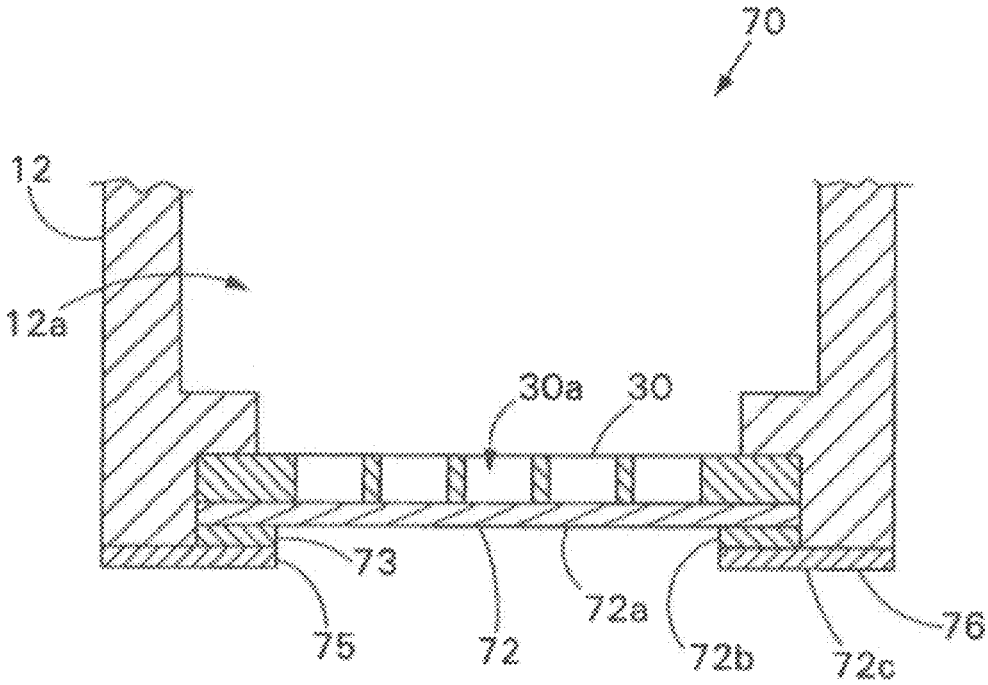
FIG. 13 is a schematic sectional drawing of yet another embodiment of an exit window mounted to the vacuum chamber of an electron beam and supported by a support plate.

Referring to FIG. 13, the exit window region of an electron beam emitter 70 is shown. Electron beam emitter 70 is similar to electron beam emitter 10 but differs in that electron beam emitter 70 includes an exit window 72. The exit window 72 has a window layer 72*a* formed of a material having high thermal conductivity positioned against the support plate 30 of electron beam emitter 70 for the passage of electrons $e^-$ of an electron beam 15 therethrough. Typically, the window layer 72*a* extends across most or all of the electron $e^-$ permeable portion of the support plate 30. An intermediate layer 72*b* on the window layer 72*a* extends around the periphery of the window layer 72*a*. A metallic structural foil layer 72*c* on the intermediate layer of 72*b* extends outwardly beyond the intermediate layer 72*b* forming a perimeter 76 for metal to metal bonding with vacuum chamber 12 to provide a gas tight seal, such as under heat and pressure, welding or brazing. The intermediate layer 72*b* and the structural foil layer 72*c* have respective openings 73 and 75, typically corresponding with each other and extending around the electron $e^-$ permeable region of the support plate 30, which are configured such that most or all of the electrons $e^-$ passing through window layer 72*a* are not impeded by layers 72*b* and 72*c*. Since the electrons $e^-$ passing through the exit window 72 only typically need to pass through the window layer 72*a*, the resistance to the electron beam 15 is minimized so that electron beam 15 has a relatively high intensity at a given voltage, or alternatively, requires lower power for a given electron beam 15 intensity. The window layer 72*a* provides a high thermal conductivity region through which electrons $e^-$ can pass, and is supported by and contacts support plate 30, which allows heat from exit window 72 and layer 72*a* to be drawn into the support plate 30 for cooling purposes.

In one embodiment, window layer 72*a* is formed of substantially flat diamond, for example, about 3 to 20 microns thick, the intermediate layer 72*b* is silicon about 0.25 to 1 mm thick and the structural foil layer 72*c* is substantially flat titanium foil about 10 to 1000 microns thick. In such an embodiment, exit window 72 can be formed by forming a layer of silicon onto titanium foil with the layer of silicon covering a smaller area than the titanium foil so that a perimeter of titanium foil extends beyond the layer of silicon. The layer of diamond 72*a* is then formed over the layer of silicon. Openings 75 and 73 are then formed through the titanium foil and the layer of silicon, for example, by etching, to expose the layer of diamond.

In other embodiments, instead of being the innermost layer as shown, the window layer 72*a* can be the outermost layer and extend over exposed surfaces of the structural foil layer 72*c*. The structural foil layer 72*c* is often titanium, but alternatively, can be formed of other suitable materials previously described as foil materials, such as aluminum, beryllium, stainless steel, copper, gold, silver, etc. In some cases, the intermediate layer 72*b* can be formed of other suitable materials or can be omitted with the window layer 72*a* being formed on the structural foil layer 72*c*. Although window layer 72*a* when formed of diamond is low density, which is desirable for efficient passage of electrons $e^-$, window layer 72*a* can include or be formed of other suitable high thermal conductive materials having higher densities, such as gold, silver and copper. In addition, window layer 72*a* can include layers of different materials, including those previously described. Although FIG. 13 depicts the perimeter 76 of exit window 72 being bonded in metal to metal contact with the outer shell of vacuum chamber 12, it is understood that the perimeter 76 can be bonded in metal to metal contact with other suitable portions of the vacuum chamber 12, for example, in some cases, the support plate 30, where the support plate 30 is shaped accordingly. Furthermore, it is understood that structural foil layer 72*c* can be covered with a corrosion resistant layer such as diamond, gold, etc.

While this invention has been particularly shown and described with references to preferred embodiments thereof, it will be understood by those skilled in the art that various changes in form and details may be made therein without departing from the scope of the invention encompassed by the appended claims.

For example, although electron beam emitter is depicted in a particular configuration and orientation in FIG. 1, it is understood that the configuration and orientation can be varied depending upon the application at hand. In addition, the various methods of forming the filaments can be employed for forming a single filament. Furthermore, although the thicknesses of the structural foils and conductive layers of the exit windows have been described to be constant, alternatively, such thicknesses may be varied across the exit windows to produce desired electron impedance and thermal conductivity profiles.

The invention claimed is:

1. An exit window for an electron beam emitter through which electrons pass in an electron beam, the exit window comprising:

a metallic structural element having an opening, wherein the metallic structural element forms a perimeter for metal to metal bonding with the electron beam emitter to create a hermetic seal; and a window layer extending across the opening of the metallic structural element.

2. The exit window of claim 1, the exit window further comprising a support plate in contact with the window layer for supporting the window layer.

3. The exit window of claim 1, wherein the exit window further comprises an intermediate layer between the window layer and the metallic structural element, wherein the intermediate layer has an opening corresponding to the opening through the metallic structural element.

4. The exit window of claim 3, wherein the metallic structural element extends outwardly beyond the intermediate layer.

5. The exit window of claim 3, wherein the intermediate layer is a silicon layer that is 0.25 to 1 mm thick.

6. The exit window of claim 1, wherein the metallic structural element comprises at least one of titanium, beryllium, aluminum, stainless steel, copper, gold, and silver.

7. The exit window of claim 1, wherein the window layer is the outermost layer of the electron beam emitter, and the window layer extends over the metallic structural element.

8. The exit window of claim 1, wherein the metallic structural element is the outermost layer of the electron beam emitter.

9. The exit window of claim 1, wherein the metallic structural element is a titanium foil.

10. The exit window of claim 1, wherein the metal to metal bond with the electron beam emitter is formed by at least one of heat, pressure, welding, and brazing.

11. A method of forming an exit window for an electron beam emitter through which electrons pass in an electron beam, the method comprising:

forming a metallic structural element having an opening, wherein the metallic structural element forms a perimeter for metal to metal bonding with the electron beam emitter to create a hermetic seal; and forming a window layer extending across the opening of the metallic structural element.

12. The method of claim 11 further comprising supporting the window layer using a support plate arranged in contact with the window layer.

13. The method of claim 11 further comprising:

forming an intermediate layer having an opening corresponding to the opening through the metallic structural element; and arranging the intermediate layer between the window layer and the metallic structural element.

14. The method of claim 13 further comprising forming the metallic structural element such that it extends outwardly beyond the intermediate layer.

15. The method of claim 13, wherein the intermediate layer is a silicon layer that is 0.25 to 1 mm thick.

16. The method of claim 11 further comprising forming the metallic structural element from at least one of titanium, beryllium, aluminum, stainless steel, copper, gold, and silver.

17. The method of claim 11, wherein the window layer is the outermost layer of the electron beam emitter, and the window layer extends over the metallic structural element.

18. The method of claim 11, wherein the metallic structural element is the outermost layer of the electron beam emitter.

19. The method of claim 11 further comprising forming the metallic structural element from a titanium foil.

20. The method of claim 11 further comprising forming, by at least one of heat, pressure, welding, and brazing, a metal to metal bond between the exit window and the electron beam emitter.

* * * * *